US010254058B2

(12) United States Patent
Battaglia et al.

(10) Patent No.: US 10,254,058 B2
(45) Date of Patent: Apr. 9, 2019

(54) LIGHT RIFLE CHASSIS

(71) Applicant: Vincent P. Battaglia, Easton, CT (US)

(72) Inventors: Vincent P. Battaglia, Easton, CT (US); Philip Battaglia, Easton, CT (US)

(73) Assignee: Vincent P. Battaglia, Easton, CT (US)

( * ) Notice: Subject to any disclaimer, the term of this patent is extended or adjusted under 35 U.S.C. 154(b) by 46 days.

(21) Appl. No.: 15/694,056

(22) Filed: Sep. 1, 2017

(65) Prior Publication Data

US 2018/0066905 A1 Mar. 8, 2018

Related U.S. Application Data

(60) Provisional application No. 62/383,023, filed on Sep. 2, 2016.

(51) Int. Cl.

| | |
|---|---|
| ***F41A 3/66*** | (2006.01) |
| ***F41C 23/16*** | (2006.01) |
| ***F41C 7/00*** | (2006.01) |
| ***F41A 11/02*** | (2006.01) |

(52) U.S. Cl.

CPC ..... *F41A 3/66* (2013.01); *F41A 11/02* (2013.01); *F41C 7/00* (2013.01); *F41C 23/16* (2013.01)

(58) Field of Classification Search

CPC .. F41A 3/66; F41A 11/00; F41A 11/02; F41C 23/16; F41C 23/20

See application file for complete search history.

(56) References Cited

U.S. PATENT DOCUMENTS

| | | | | |
|---|---|---|---|---|
| 8,429,844 | B2 | 4/2013 | Dextraze et al. | |
| 9,157,696 | B2 | 10/2015 | Dextraze | |
| 2016/0209137 | A1* | 7/2016 | DeSomma | F41A 3/82 |
| 2018/0142981 | A1* | 5/2018 | Collazo | F41A 21/36 |
| 2018/0172375 | A1* | 6/2018 | Stangl | F41A 3/26 |
| 2018/0259276 | A1* | 9/2018 | Doll | F41A 3/66 |

* cited by examiner

*Primary Examiner* — J. Woodrow Eldred

(74) *Attorney, Agent, or Firm* — DeLio, Peterson & Curcio, LLC; Peter W. Peterson

(57) ABSTRACT

A lightweight rifle has a chassis with a forward receptacle and rear receptacle, a forend tube with a male key, a barrel, a breech, a spacer, a trigger guard, a grip, and a butt stock adapter. The barrel and breech connect along a shared longitudinal axis, and the resulting subassembly inserts into the forend tube. The spacer secures the connection between the breech and the forend tube with a combination of scope screws and rivets that extend through the forend tube, spacer, and breach, respectively. This forend tube subassembly connects to the chassis by inserting the forend tube male key into the chassis forward receptacle and further securing the male key and forward receptacle together with bolts. The butt stock adapter has a protruding male key and mates to the chassis rear receptacle. This allows for the quick and secure connection of a butt stock to the rifle chassis.

16 Claims, 8 Drawing Sheets

LIGHT RIFLE CHASSIS

This application claims priority to U.S. Provisional Patent Application No. 62/383,023, filed on Sep. 2, 2016.

OBJECT OF THE INVENTION

1. Field of the Invention

This invention relates in general to a rifle chassis, and more specifically to a modular chassis.

2. Description of Related Art

Presently, modern firearms often include various accessories to assist the shooter in aiming and successfully hitting their target. These devices are mountable to the firearm itself or to a mount associated with the firearm. Such mounts may include a Picatinny rail—a bracketed platform consisting of rails with multiple traversed slots used on firearms, and meant to provide a standard mounting platform for attachments and accessories, including (but not limited to) scopes, flashlights, and laser sights. These accessories are mounted by sliding them onto the rail through the use of a clamping structure, or by affixing the accessories into the traversed slots. However, the available space for accessories and the range of different compatible accessories are severely limited to the firearm model, the necessity to install a mount, and the available space on that mount.

In the constant refinement of the center fire rifle, machined rifle chassis have become desirable in the market place—especially machined chassis that emulate features of AR15 type modern sporting rifles. This duality allows sportsmen to have modularity between a common platform for accessories and common sport shooting technique, as well as a much greater range of customizing options.

SUMMARY

Bearing in mind the problems and deficiencies of the prior art, it is therefore an object of the present invention to provide a machined rifle chassis which emulates features of AR15 type modern sporting rifles and creates a common platform for firearm accessories and common sport shooting technique.

Another object of the present invention is to provide a forend tube having a more stable platform meant for attaching accessories.

A further object of the present invention is to provide a spacer that achieves a more secure attachment between the accessory mount and the rifle action.

Still another object of the present invention is to provide a male key structure that creates a more stable connection between the chassis and the accessory platform.

Yet another object of the present invention is to provide a more lightweight rifle design without sacrificing durability or accuracy.

The above and other objects, which will be apparent to those skilled in the art, are achieved in the present invention which is directed to a rifle assembly comprising a central chassis having a longitudinal axis for carrying a modular receiver including a breech, a modular barrel connected to the receiver, and a modular forend tube. The chassis includes a trigger guard, a grip, and a forward receptacle for securing the forend tube. The modular forend tube consists of a forward tubular portion for receiving the barrel, and a central opening aligned with the tubular portion for receiving the modular receiver. A male key extends downward from the tubular portion configured to mate with the chassis female key receptacle to secure the forend tube thereto. A Picatinny rail extends over the forend tube including the forward tubular portion and the central opening. The forend tube at the central opening is spaced from the modular receiver when secured to the central chassis. The forend tube includes the forward tubular portion, the central opening and the Picatinny rail being integrally constructed of one piece. The forend tube is securable to the receiver and central chassis simultaneously. In certain embodiments, the forend tube and the modular barrel may be composed of a material having a density lighter than that of steel.

Another aspect of the present invention provides a rifle assembly comprising a central chassis having a longitudinal axis for carrying a modular receiver, a modular receiver including a breech, a modular barrel connected to the receiver, a modular forend tube having a forward tubular portion for receiving the barrel, and a spacer between the forend tube and the receiver. The chassis includes a trigger guard, a grip, and a forward receptacle for securing the forend tube. The forend tube has a central opening aligned with the forward tubular portion for receiving the receiver. A key extends downward from the tubular portion and is configured to mate with the chassis receptacle to secure the forend tube thereto. A rail extends over the forend tube including the forward tubular portion and the central opening, the forend tube at the central opening being spaced from the receiver when secured to the central chassis. A spacer lies between the forend tube and the modular receiver. The spacer connects the forend tube and the modular receiver forward and rearward of the breech.

In a certain embodiment, the spacer comprises one piece and spans the breech. In further embodiments, the spacer comprises more than one piece. The spacer in either of these embodiments may also be composed of a material having a density lighter than that of steel.

Still another aspect of the present invention provides a rifle assembly comprising a central chassis having a longitudinal axis for carrying a modular receiver, a modular receiver including a breech, a modular barrel connected to the receiver, and a modular forend tube having a forward tubular portion for receiving the barrel. The central chassis includes a trigger guard, grip, and a forward female receptacle for securing the forend tube. The forend tube includes a central opening aligned with the tubular portion for receiving the receiver. A male key extends downwards from the tubular portion and is configured to mate with the chassis female receptacle to secure the forend tube thereto. A rail extends over the forend tube including the forward tubular portion and the central opening.

In a further embodiment, a longitudinal axis of the rail extending over the forend tube is parallel to a longitudinal axis of the male key extending downwards from the forend tube.

Yet another aspect of the present invention provides a rifle assembly comprising a central chassis having a longitudinal axis for carrying a modular receiver, a modular receiver including a breech, a modular barrel connected to the receiver, a modular forend tube having a forward tubular portion for receiving the barrel, a spacer between the forend tube and the receiver, and a butt stock adapter having a forward-facing projection abutting the central chassis rearward-facing receptacle and removably securable thereto. The central chassis includes a trigger guard, grip, a forward receptacle for securing the forend tube, and a rearward-facing female receptacle for securing a butt stock. The forend tube includes a central opening aligned with the tubular portion for receiving the receiver. A male key extends downwards from the tubular portion and is configured to mate with the chassis female receptacle to secure the forend tube thereto. A rail extends over the forend tube including the forward tubular portion and the central opening. The forend tube at the central opening is spaced from the receiver when secured to the central chassis, the forend tube including the forward tubular portion, the central opening and the rail being integrally constructed of one piece. The spacer spans the breech and connects the forend tube and the receiver forward and rearward of the breech. One of the butt central chassis rearward-facing receptacle and the butt stock adapter forward-facing projection has a substantially cylindrical projection with a downward extending male projection. The other of the central chassis rearward-facing receptacle and the butt stock adapter forward-facing projection has a substantially cylindrical indentation with a downward extending female indentation configured to mate with the one of the central chassis rearward-facing receptacle and the butt stock adapter forward-facing projection. The downward extending male projection and the downward extending female indentation, when mated, prevent rotation of the butt stock adapter with respect to the central chassis along the longitudinal axis.

A further aspect of the present invention provides a method of assembling a lightweight rifle. The method provides a central chassis having a longitudinal axis for carrying a modular receiver, barrel, and forend tube, a modular receiver including a breech, a modular barrel connected to the receiver, a modular forend tube having a forward tubular portion for receiving the barrel, and a spacer between the forend tube and the receiver. The central chassis includes a trigger guard, a grip, and a forward female receptacle for securing the forend tube. The forend tube includes a central opening aligned with the tubular portion for receiving the receiver. A male key extends downward from the tubular portion and is configured to mate with the chassis female receptacle to secure the forend tube thereto. A rail extends over the forend tube including the forward tubular portion and the central opening. The forend tube at the central opening is spaced from the receiver when secured to the central chassis. The forend tube including the forward tubular portion, the central opening, and the rail are integrally constructed of one piece. The spacer connects the forend tube to the receiver forward and rearward of the breech, the spacer being in at least one position forward or rearward of the breech. The male key of the forend tube is inserted into the female receptacle of the central chassis.

In an embodiment, the method further includes securing the spacer to the forend tube and receiver with at least one rivet. An alternate embodiment includes securing the spacer to the forend tube and receiver with at least one screw. The method may further include securing the butt stock adapter to the butt central chassis rearward-facing receptacle with at least one bolt. The method may also include connecting the spacer to the forend tube and to the receiver, the spacer being in a position forward and rearward of the breech. The spacer may be composed of one piece that spans the gap of the breech. In still another embodiment, the method may include connecting the spacer to the forend tube and to the receiver, the spacer being in a position forward and rearward of the breech, the spacer being composed of more than one piece.

DESCRIPTION OF THE EMBODIMENT(S)

In describing the embodiment(s) of the present invention, reference will be made herein to FIGS. 1-18 of the drawings in which like numerals refer to like features of the invention.

Figure 1:
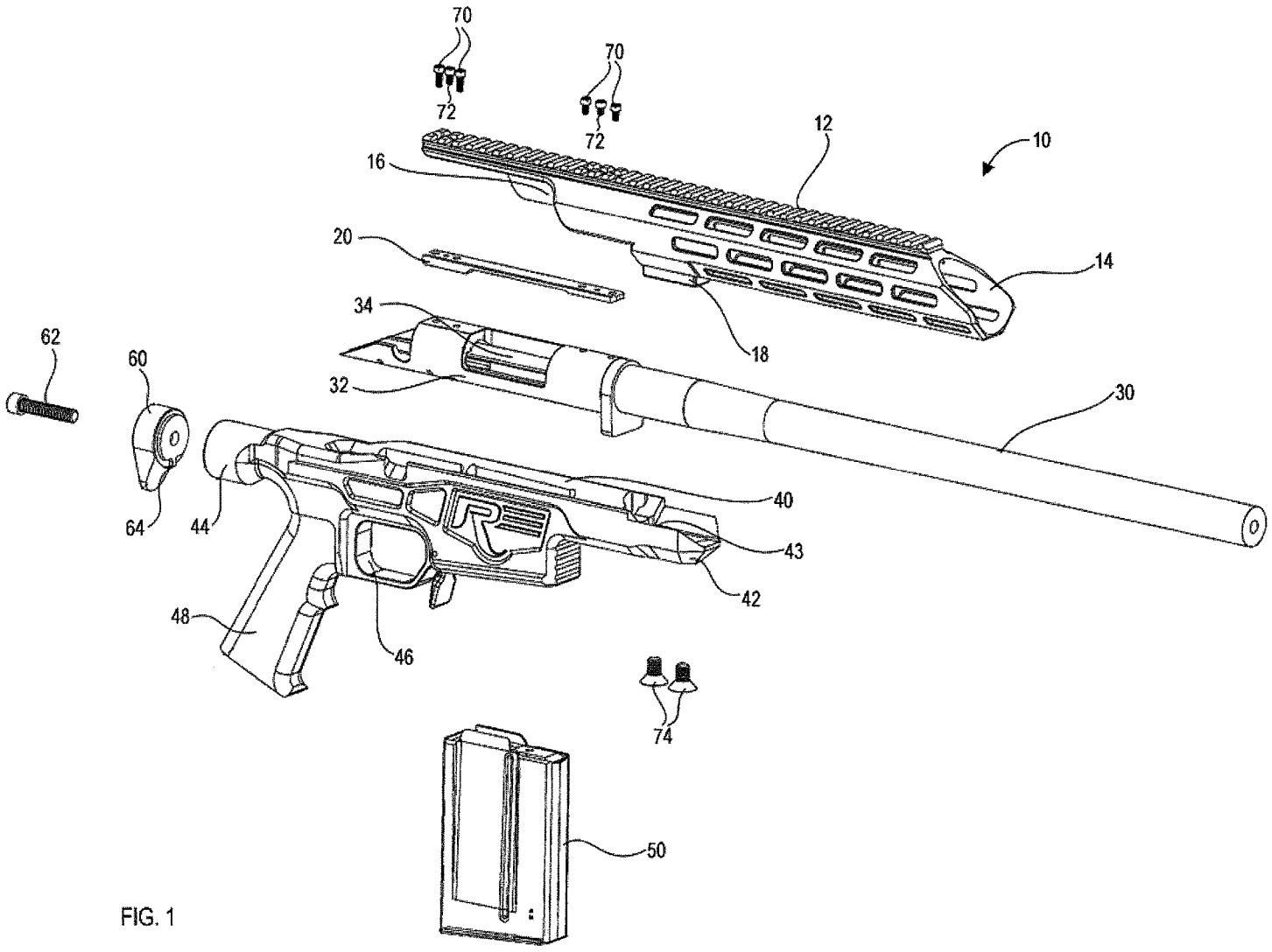
FIG. 1 is a perspective, exploded view of a portion of an embodiment of the modular center fire rifle of the present invention.

In the embodiment of the present invention shown in FIG. 1, a rifle assembly comprises a forend tube 10, a breech 34 and accompanying barrel 30, and a spacer 20 set between the forend tube 10 and the breech 34. A chassis 40 is designed for receiving the forend tube 10, spacer 20, and breech 34 subassembly, as well as an ammunition magazine 50, and a butt stock adapter 60 for receiving a stock.

Referring to FIGS. 1, 6, and 7-10, the forend tube 10 may include a full length Picatinny rail 12 affixed to the flat top planar portion of the forend tube 10. The forend tube 10 as shown has a central opening 16 and a forward tubular portion 14 for receiving and enveloping a barrel 30. Forend tube 10 is unitary and is made of a single piece in the example shown. A male key 18 is affixed to and projecting from the bottom planar surface of the forward tubular portion 14. The male key 18 is located at about the mid-point of the bottom planar surface of the forend tube 10. The central opening 16 is aligned with the forward tubular portion 14 and receives a modular receiver 32 directly below. The forend tube 10 is connected to both the modular receiver 32 and the chassis 40 simultaneously in the mounting structure shown. For example, the forend tube 10 and barrel 30 may be composed of (but not limited to) steel, alloy, carbon fiber, and the like, and may be made with suitable materials having a lower density than steel.

The configuration of the forend tube 10 enables dual mounting so that the chassis 40 is also directly secured to the modular receiver 32 by otherwise conventional fasteners (not shown). This may be further facilitated via an adapter (not shown) configured to be used or changed between any rifle receiver mounting platform and elevation. The forend tube 10 configuration thus allows for common day/night optic mounting (on the Picatinny rail) between an AR15 type sporting rifle with a machined chassis 40.

The chassis 40 includes a forward receptacle 42 and a rearward receptacle 44. A female key receptacle 43 receives the male key 18 and has a corresponding shape indented within the forward receptacle 42. A slot on the bottom planar edge beneath the forward receptacle 42 holds a magazine 50, which may contain rounds compatible with either bolt-action or semi-automatic firearms, depending on the user's preference. Extending beneath the exemplary chassis 40 on the side of the rearward receptacle 44 is a pistol grip 48 which contains a trigger guard 46 extending from the vertical edge of the pistol grip 48 and is connected to the bottom edge of the chassis 40. The pistol grip 48 may comprise a smooth or rugged surface to improve user grip strength or to meet personal preferences. Other types of grips and trigger guards may be used.

Figure 13:
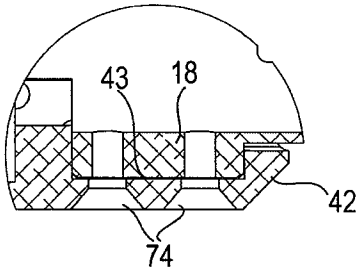
FIG. 13 is a close-up side cross-sectional view of the connected forend tube male key and chassis female receptacle within section 13 of FIG. 12.
Figure 12:
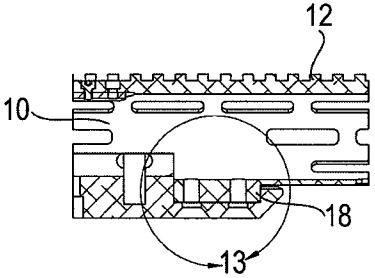
FIG. 12 is a side cross-sectional view of the forend tube and chassis assembly along line 12-12 of FIG. 11.

The male key 18 of the forward tubular portion 14 communicates with the female key receptacle 43 located in the top planar edge of the forward receptacle 42 of the chassis 40. The male key 18 is longer in the direction of the barrel 30 centerline axis and is secured to the female key receptacle 43 with fasteners, such as two screws 74 (FIGS. 1 and 12-13). The forward tubular portion 14 extends beyond the connected male key 18 and female receptacle 42 when the forend tube 10 and chassis 40 are assembled. When assembled, the longitudinal axis of the rail 12 extending over the forend tube 10 is parallel to the longitudinal axis of the male key 18.

Figure 4:
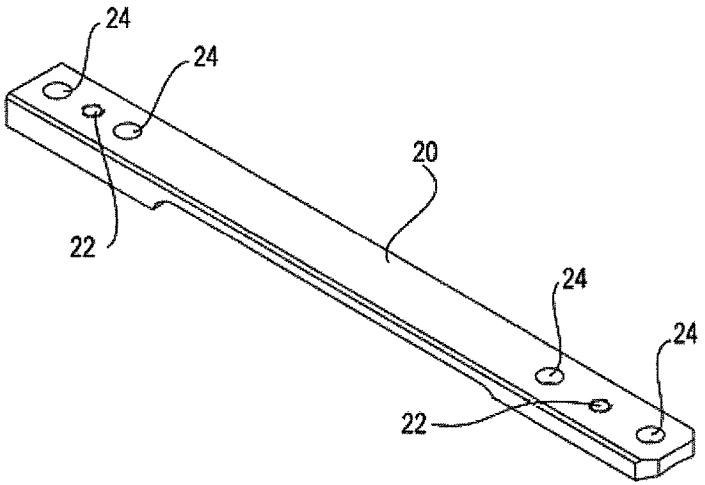
FIG. 4 is a perspective view of the spacer used on the modular center fire rifle of the present invention of FIG. 1.
Figure 5:
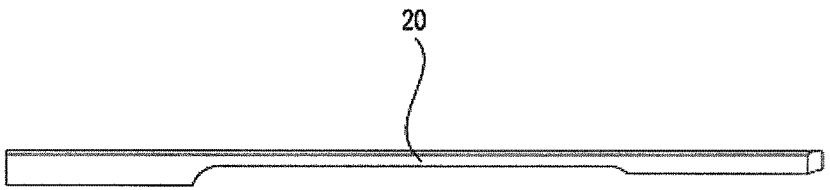
FIG. 5 is a side elevational view of the spacer of FIG. 4.
Figure 6:
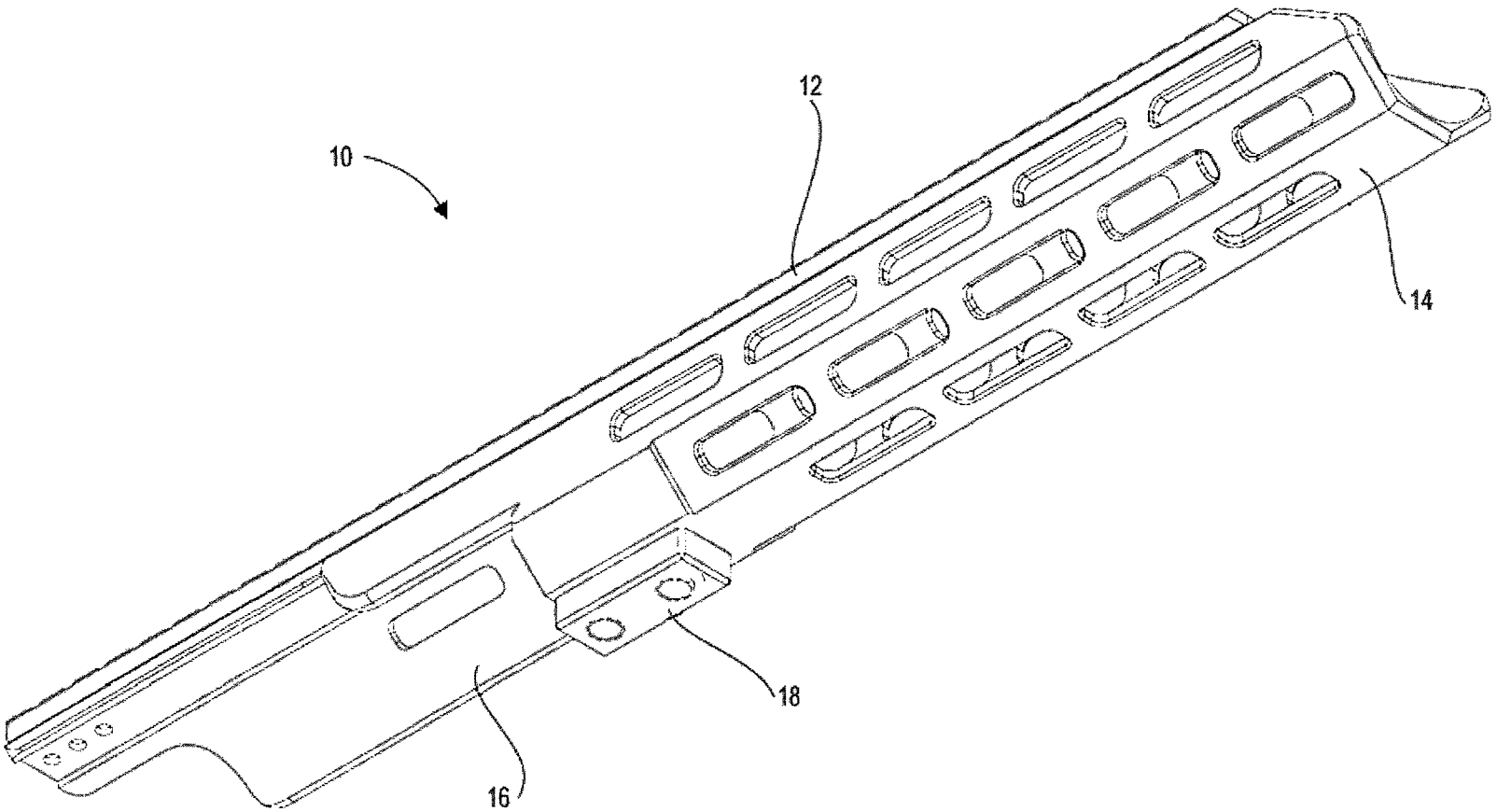
FIG. 6 is a perspective view of the modular forend used on the modular center fire rifle of the present invention of FIG. 1.
Figure 7:
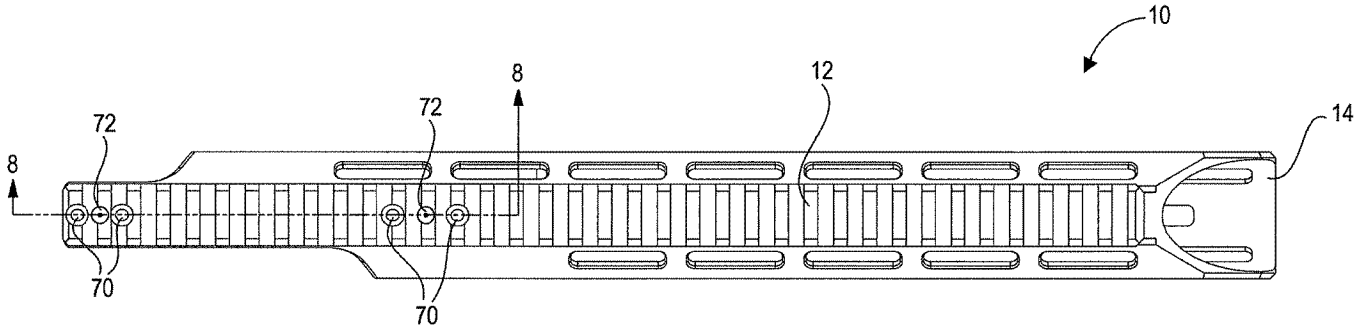
FIG. 7 is a top-down view of the forend tube of FIG. 6.
Figure 9:
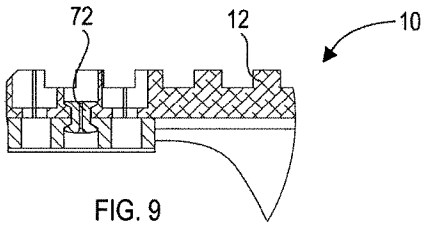
FIG. 9 is a close-up side cross-sectional view of the forend tube and spacer assembly within section 9 of FIG. 8.
Figure 8:
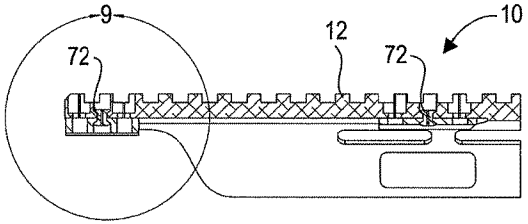
FIG. 8 is a side cross-sectional view of the forend tube and spacer assembly along line 8-8 of FIG. 7.
Figure 10:
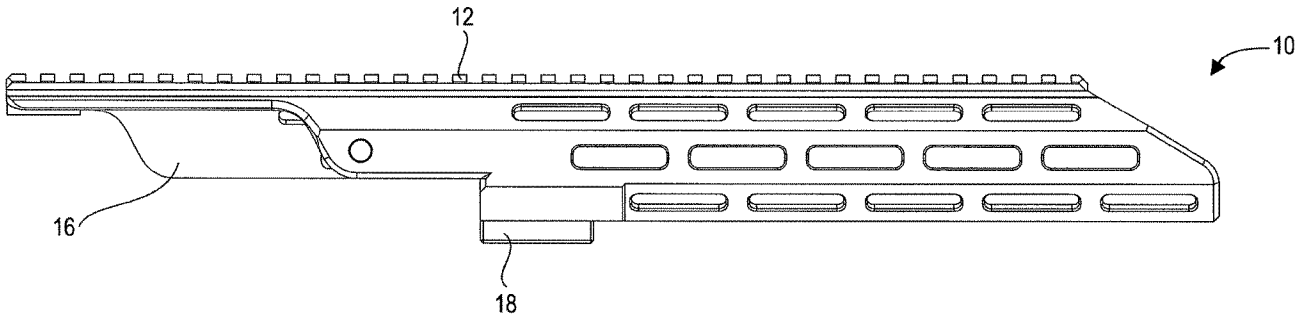
FIG. 10 is a side elevational view of the forend tube of FIG. 6.
Figure 11:
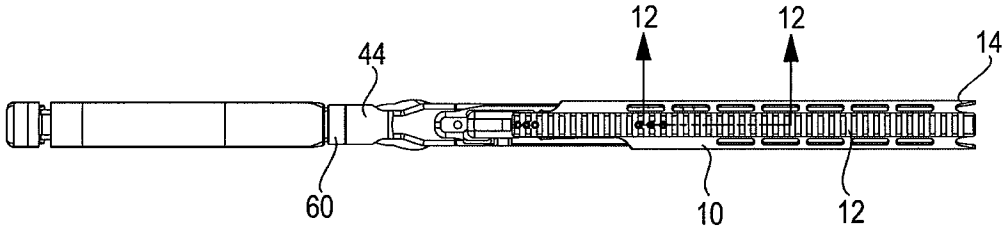
FIG. 11 is a top plan view of a portion of the assembled rifle of FIG. 1.
Figure 17:
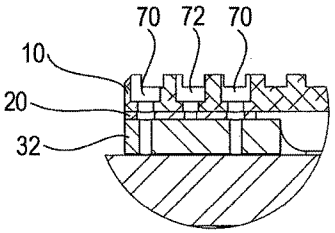
FIG. 17 is a close-up cross-sectional view of the forend tube, spacer, and receiver assembly within section 17 of FIG. 16.
Figure 14:
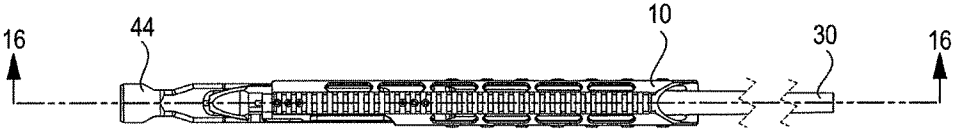
FIG. 14 is a top plan view of a portion of the assembled rifle of the present invention.
Figure 15:
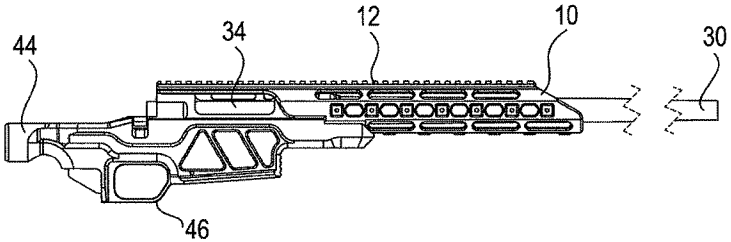
FIG. 15 is a side elevational view of the assembled rifle of the present invention.
Figure 16:
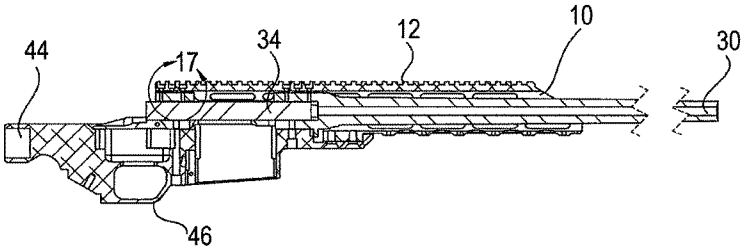
FIG. 16 is a side cross-sectional view of the assembled rifle of the present invention across line 16-16 of FIG. 14.

Referring to FIGS. 1 and 4-5, the modular receiver 32 includes a barrel action/breech 34 for inserting or loading an ammunition shell. The modular receiver 32 is aligned with and affixed to the barrel 30. A spacer 20 is secured to the top planar portion of the modular receiver 32 and spans the gap of the barrel action/breech 34. The spacer 20 connects the top planar portion of the modular receiver 32 to the top inside face of the forend tube 10 in the forward and rearward areas of the barrel action/breech 34. The spacer 20 may be manufactured for any action length and scope mounting hole arrangement, and may be composed of steel, alloy, carbon fiber, or of any other suitable material with a density lighter than steel. The spacing and size of openings 22, 24 in the spacer may be selected to enable it to be secured by fasteners to the forend tube and also to accommodate scope mounting holes of a bolt-action rifle, as depicted in FIG. 4. The spacer 20 bridges the elevation difference between the selected modular receiver 32 type and the forend tube 10. As depicted in FIGS. 16-17, the spacer 20 may be affixed to the forend tube 10 with traditional scope screws 70, such as in openings 24 as shown. Rivets 72 may be also used in place of one or more of the traditional scope screws 70 such as in openings 22 as shown, or the rivets 72 may be intermingled with the scope screws 70 to achieve a permanent connection between the spacer 20 and the forend tube 10 (FIG. 17). If rivets 72 are used, the spacer 20 and forend tube 10 may be packaged together as a sub-assembly. Sub-assembling the spacer 20 and forend tube 10 with rivets 72 provides a cost-effective way of manufacturing the rifle chassis.

Figure 18:
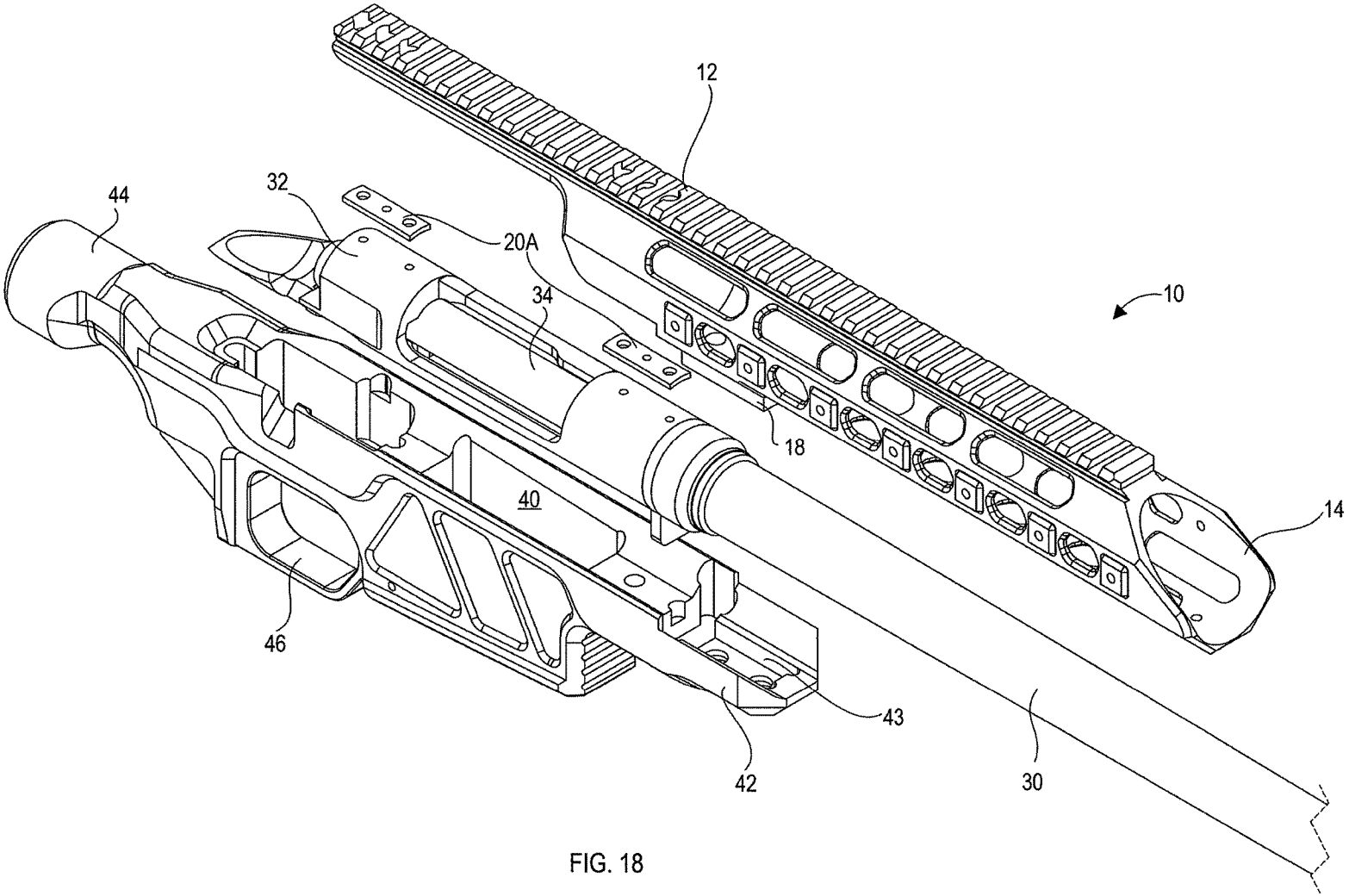
FIG. 18 is an exploded perspective view of a portion of the rifle assembly of the present invention using an alternate embodiment of the spacer.

FIG. 18 depicts a rifle chassis using an alternate construction of the spacer 20A. This spacer 20A is composed of two separate pieces, one piece which affixes the rear-facing side of the modular receiver 32 to the top inside face of the forend tube 10, the other piece affixing the front-facing side of the receiver 32 to the top inside face of the forend tube 10. Both pieces of the spacer 20A straddle the opening of the breech 34 across the receiver's 32 top planar face. Separation of this spacer 20A into two separate pieces may provide lower manufacturing costs.

Figure 2:
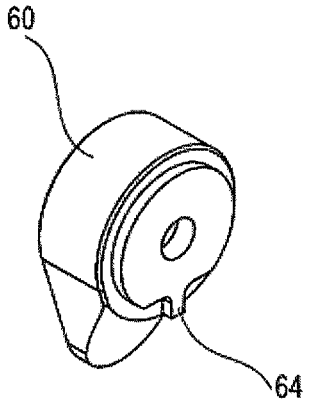
FIG. 2 is a perspective view of the butt stock adapter with the anti-rotation key used on the modular center fire rifle of the present invention of FIG. 1.
Figure 3:
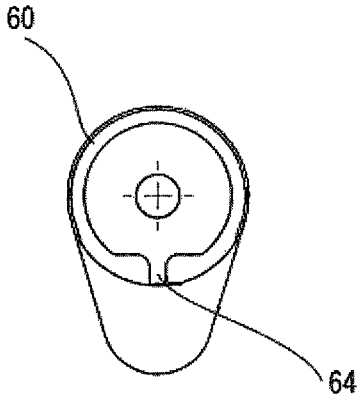
FIG. 3 is a front elevational view of the butt stock adapter of FIG. 2.

Referring to FIGS. 1-3, a butt stock adapter 60 may be affixed to the rearward receptacle 44 located on the rear vertical edge of the chassis 40 by a butt stock adapter bolt 62. This butt stock adapter 60 system allows both AR15 type butt stock systems as well as adjustable tube type systems to be mounted to the chassis 40 in rearward receptacle 44. The butt stock adapter 60 comprises a butt stock adapter key 64 which secures the rotation of the mounting at 0 degrees, i.e., in a vertical position.

Full assembly of an embodiment of the lightweight rifle of the present invention may be demonstrated by reference to FIG. 1. The spacer 20 is first affixed to the top inside face of the forend tube 10 near the rear portion of the Picatinny rail 12. A combination of scope screws 70 and rivets 72 may be employed to secure the spacer 20 to the forend tube 10. The barrel 30 connects to the breech 34 across their shared longitudinal axis, the breech 34 receiving the barrel 30 in a tight sliding fit. In the alternative, the barrel 30 and breech 34 may also connect with threaded ends on the connecting sides of both the barrel 30 and breech 34. After securing the spacer 20 to the forend tube 10, the forend tube 10 receives the breech 34 and barrel 30 sub-assembly through its central opening 16 and forward tubular portion 14. The same scope screws 70 and rivets 72 used to secure the spacer 20 to the forend tube 10 are also used to secure the bottom planar face of the spacer 20 to the top planar face of the breech 34. The resulting sub-assembly comprising the forend tube 10, spacer 20, breech 34, and barrel 30 may be connected to the chassis 40. The male key 18 projecting from the bottom planar face of the forend tube 10 mates with the female receptacle 43 located at the front end of the chassis 40. The forend tube 10 sub-assembly is then affixed to the chassis 40 with key screws 74, which extend through the bottom of the forward receptacle 42, the female receptacle 43, and the male key 18. Finally, the butt stock adapter 60 is affixed to the rearward receptacle 44 of the central chassis 40 with an adapter bolt 62 that extends through the body of the butt stock adapter 60 and into the threaded bore located in the center of the rearward receptacle 44 meant for receiving the bolt 62. Other orders of assembly of the individual components may be utilized.

Accordingly, the present invention provides one or more advantages: 1) a more stable platform for scopes and sporting rifle accessories; 2) a more secure attachment between the accessory mount and rifle action; 3) a more stable connection between the chassis and the accessory platform; 4) easier interchangeability of rifle butt stocks while simultaneously ensuring a strong connection; 5) a modular chassis designed for use in modern sporting rifles; 6) a more lightweight rifle design that maintains a durable structure without losing accuracy.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A rifle assembly comprising:

a central chassis having a longitudinal axis for carrying a modular action, barrel, and forend tube, the chassis including a trigger guard, a grip, and a forward receptacle for securing the forend tube;

a modular receiver including a breech;

a modular barrel connected to the receiver; and a modular forend tube having a forward tubular portion for receiving the barrel, a central opening aligned with the tubular portion for receiving the receiver, and a rail extending over the forend tube including the forward tubular portion and the central opening, the forend tube including the forward tubular portion, the central opening, and the rail being integrally constructed of one piece, the forend tube being securable to the receiver and central chassis simultaneously.

2. The rifle assembly of claim 1 wherein the forend tube is composed of a material having a density lighter than that of steel.

3. The rifle assembly of claim 1 wherein the modular barrel is composed of a material having a density lighter than that of steel.

4. A rifle assembly comprising:

a central chassis having a longitudinal axis for carrying a modular receiver, barrel, and forend tube, the chassis including a trigger guard, a grip, and a forward receptacle for securing the forend tube;

a modular receiver including a breech;

a modular barrel connected to the receiver;

a modular forend tube having a forward tubular portion for receiving the barrel, a central opening aligned with the tubular portion for receiving the receiver, a key extending downward from the tubular portion configured to mate with the chassis receptacle to secure the forend tube thereto; and a rail extending over the forend tube including the forward tubular portion and the central opening, the forend tube at the central opening being spaced from the receiver when secured to the central chassis; and a spacer between the forend tube and the receiver, the spacer connecting the forend tube and the receiver forward and rearward of the breech.

5. The rifle assembly of claim 4 wherein the spacer is of one piece and spans the breech.

6. The rifle assembly of claim 4 wherein the spacer comprises more than one piece.

7. The rifle assembly of claim 4 wherein the spacer is composed of a material having a density lighter than that of steel.

8. A rifle assembly comprising:

a central chassis having a longitudinal axis for carrying a modular receiver, barrel, and forend tube, the chassis including a trigger guard, a grip, and a forward female receptacle for securing the forend tube;

a modular receiver including a breech;

a modular barrel connected to the receiver; and a modular forend tube having a forward tubular portion for receiving the barrel, a central opening aligned with the tubular portion for receiving the receiver, a male key extending downward from the tubular portion configured to mate with the chassis female receptacle to secure the forend tube thereto; and a rail extending over the forend tube including the forward tubular portion and the central opening.

9. The rifle assembly of claim 8 wherein a longitudinal axis of the rail extending over the forend tube is parallel to a longitudinal axis of the male key extending downward from the forend tube.

10. A rifle assembly comprising:

a central chassis having a longitudinal axis for carrying a modular receiver, barrel, and forend tube, the chassis including a trigger guard, a grip, a forward receptacle for securing the forend tube and a rearward-facing female receptacle for securing a butt stock;

a modular receiver including a breech;

a modular barrel connected to the receiver;

a modular forend tube having a forward tubular portion for receiving the barrel, a central opening aligned with the tubular portion for receiving the receiver, a male key extending downward from the tubular portion configured to mate with the chassis female receptacle to secure the forend tube thereto; and a rail extending over the forend tube including the forward tubular portion and the central opening, the forend tube at the central opening being spaced from the receiver when secured to the central chassis, the forend tube including the forward tubular portion, the central opening and the rail being integrally constructed of one piece; and a spacer between the forend tube and the receiver, the spacer spanning the breech and connecting the forend tube and the receiver forward and rearward of the breech.

11. A method of assembling a lightweight rifle, comprising:

providing a central chassis having a longitudinal axis for carrying a modular receiver, barrel, and forend tube, the chassis including a trigger guard, a grip, and a forward female receptacle for securing the forend tube;

providing a modular receiver including a breech;

providing a modular barrel connected to the receiver;

providing a modular forend tube having a forward tubular portion for receiving the barrel, a central opening aligned with the tubular portion for receiving the receiver, a male key extending downward from the tubular portion configured to mate with the chassis female receptacle to secure the forend tube thereto; and a rail extending over the forend tube including the forward tubular portion and the central opening, the forend tube at the central opening being spaced from the receiver when secured to the central chassis, the forend tube including the forward tubular portion, the central opening, and the rail being integrally constructed of one piece;

providing a spacer between the forend tube and the receiver, the spacer connecting the forend tube to the receiver forward and rearward of the breech;

connecting the spacer to the forend tube and to the receiver, the spacer being in at least one position forward or rearward of the breech; and inserting the male key of the forend tube sub-assembly into the female receptacle of the central chassis.

12. The method of claim 11 further including securing the spacer to the forend tube and receiver with at least one rivet.

13. The method of claim 11 further including securing the spacer to the forend tube and receiver with at least one screw.

14. The method of claim 11 further including securing the butt stock adapter to the butt central chassis rearward-facing receptacle with at least one bolt.

15. The method of claim 11 further including connecting the spacer to the forend tube and to the receiver, the spacer being in a position forward and rearward of the breech, the spacer being composed of one piece that spans the gap of the breech.

16. The method of claim 11 further including connecting the spacer to the forend tube and to the receiver, the spacer being in a position forward and rearward of the breech, the spacer being composed of more than one piece.

* * * * *